US005423362A

United States Patent [19]

Knight

[11] Patent Number: 5,423,362

[45] Date of Patent: Jun. 13, 1995

[54] APPARATUS FOR FORMING AN ACCESS POCKET AT THE TERMINAL END OF A POST-TENSIONED TENDON

[76] Inventor: David W. Knight, 1210 Hamblen Rd., Ste. 200, Kingwood, Tex. 77339

[21] Appl. No.: 135,454

[22] Filed: Oct. 12, 1993

[51] Int. Cl.[6] ..... B28B 23/06

[52] U.S. Cl. ..... 249/91; 249/97; 249/142; 249/175; 249/217; 264/228; 425/111

[58] Field of Search ..... 249/91, 97, 142, 175, 249/177, 187.1, 217; 264/228; 425/111; 52/223.13

[56] References Cited

U.S. PATENT DOCUMENTS

| | | | |
|---|---|---|---|
| 1,851,339 | 3/1932 | Williams | 249/217 |
| 3,844,697 | 10/1974 | Edwards | 249/217 |
| 3,956,797 | 5/1976 | Brandestini et al. | 425/111 |
| 4,053,974 | 10/1977 | Howlett et al. | 264/228 |
| 4,363,462 | 12/1982 | Wlodkowski et al. | 249/217 |

*Primary Examiner*—James P. Mackey
*Attorney, Agent, or Firm*—Harrison & Egbert

[57] ABSTRACT

A pocket former having a body with a tapered exterior surface. The body has a top surface and a bottom surface and a tubular member extending therethrough. The top surface extends outwardly from the tubular member for a greater distance than the bottom surface. The top surface and the bottom surface define a pocket therebetween. The top surface tapers to the bottom surface. The pocket has a generally semi-circular configuration at one end with a top surface forming a linear edge of the semi-circular configuration. The pocket has another portion of generally circular configuration. A plurality of radial struts extend from the tubular member to the top and bottom surfaces.

9 Claims, 3 Drawing Sheets

APPARATUS FOR FORMING AN ACCESS POCKET AT THE TERMINAL END OF A POST-TENSIONED TENDON

TECHNICAL FIELD

The present invention relates to corrosion protection of the terminal end of a post-tensioned steel tendon by forming a specially shaped access pocket at the stressing end of the tendon. More specifically, it relates to a method for 1) installing a specially designed pocket former on the tendon, between the anchor body and the form surface prior to placement of concrete, 2) cutting of the tendon within this pocket after stressing, and 3) grouting of the access pocket with a corrosion protective non-shrink grout. This specially designed pocket provides access for readily available abrasive cutting tools to properly trim excess tendon length after stressing.

BACKGROUND ART

Post-tensioning is a type of steel reinforcement for concrete structures. It typically refers to the method of placing wet concrete around unstressed tendons that have been coated with grease and encased in a plastic sheath. After sufficient hardening of the concrete the tendons are pulled, or post-tensioned, to provide strength to the structure. The tendons are then anchored and cut off just inside the face of the structure in what are termed"pockets". The"pockets" surrounding these tendon ends are then filled with a concrete grout.

The basic procedures used in prestressing or post-tensioning concrete structures have been known since the 1940's, and development of these procedures is traceable to the late 1920's. However, general acceptance and extensive use of post-tensioning did not begin until the late 1960's or early 1970's. The use of post-tensioning is especially suited to slab construction such as multi-level floor slabs in parking garages and buildings, or slabs-on-ground such as in residential construction. The post-tensioned slab-on-ground foundation for residential construction has become the system of choice for many builders in areas that have a relatively flat terrain. The primary reason for this is its economy and ease of installation.

Corrosion protection is provided for most of the tendon length by a coating of grease and a plastic sheath installed by the manufacturer. However, the plastic sheath must be removed at each terminal end for anchorage. This results in a length of bare tendon and an anchor assembly that are protected only by the concrete grout installed by the tensioner at the time of stressing. Corrosion problems typically result due to an inadequate thickness of concrete covering the terminal end of the tendon. The end of the tendon must be cut off a sufficient distance inside the face of the slab to prevent corrosion from starting and cracking the concrete grout seal. The minimum required clearance distance for prestressing steel from an exterior formed concrete surface is one inch. This minimum distance is critical in order to prevent contact of the steel with weathered, or carbonated, concrete. Carbonated concrete is concrete that has reacted with $CO_2$ in the atmosphere over a period of time. This carbonation lowers the pH of the concrete to a level that is no longer non-corrosive to steel, and the steel begins to corrode. This is a condition that is beginning to affect numerous concrete structures where steel is present within the zone of carbonation. This condition is especially serious in post-tensioned structures since most pocket formers for post-tensioning anchorages make a pocket only $1\frac{3}{8}$ to $1\frac{1}{2}$-inches deep, and many tendons are not trimmed a sufficient distance inside the pocket.

Although post-tensioned structures are designed to be maintenance free for decades, and by all Codes the terminal end anchorages are supposed to be permanently protected against corrosion, it became apparent in the early 1980's that structures installed in corrosive environments were failing after only a few years due to failure of the grout seal and severe corrosion at the terminal end anchorages. Subsequently, coated tendons and encapsulating anchors were developed and are now used for corrosive environments. However, residential construction has continued with very little change from the methods used in the 1960's and 1970's. It has now become apparent that premature failure of concrete grout seals is causing failure of terminal and anchorages in all types of structures, and specifically in large numbers of single and multi-family residential structures. Most owners of post-tensioned structures are unaware of the type of reinforcing they have, and are not knowledgeable about inspection or maintenance of the terminal ends of the post-tensioned tendons.

Only recently has a tool become available for easily cutting the excess tendon length more than about $\frac{1}{4}$-inch inside the pocket. This tool is a hydraulic shear device that fits into a standard pocket to cut the tendon and provide for installation of an adequate grout cover. The need for cutting the tendon a sufficient distance inside the face of the structure has been known for decades, but gas torch cutting has been banned in most areas due to the potential for heat damage in the anchorage zone, and the recently available hydraulic shear device is exorbitantly expensive to purchase and maintain.

The present invention is directed at the large numbers of tendons being installed in a normal service environment, such as in residential structures, where an economical means for properly trimming excess tendon length is needed, in order to permanently protect the anchorages from corrosion.

SUMMARY OF THE INVENTION

The present invention provides a method and apparatus for protecting the terminal end of a post-tensioned steel tendon by forming a specially designed pocket at the stressing end of the tendon. This specially designed pocket provides access for readily available tools to properly trim the excess tendon length after stressing, which then allows installation of a corrosion protection grout cover.

More specifically, the specially designed pocket is shaped to receive any one of several specific abrasive cutting tools that are readily available at low cost. The pocket allows access of the specific cutting tool to a depth of one inch inside the face of the concrete structure in order to cut the excess length of tendon. The pocket is then grouted to provide a corrosion protective cover over the tendon of approximately one inch or more.

This protection is accomplished in the preferred embodiment by the installation of a pocket former between the anchor and the form surface, which is shaped specifically to receive a four to seven inch abrasive cutting wheel mounted on an angle grinder. The abrasive cutting wheel is inserted into the access pocket after concrete has been placed and the tendon stressed, and the excess tendon length is cut to leave a minimum ½"-¾" tendon extension from the anchor wedges, and a minimum one inch space for filling with protective grout. The pocket is then filled with a non-shrink cementitious grout for permanent corrosion protection of the tendon anchorage.

The specially designed pocket former may be of various shapes designed to provide access for a specific abrasive cutting tool. The installation of this specially designed pocket former to facilitate proper trimming and grouting is anticipated to provide a greatly extended service life to tendons in new structures that might otherwise exhibit premature failure causing both property damage and personal injury.

DETAILED DESCRIPTION OF THE INVENTION

Figure 1:
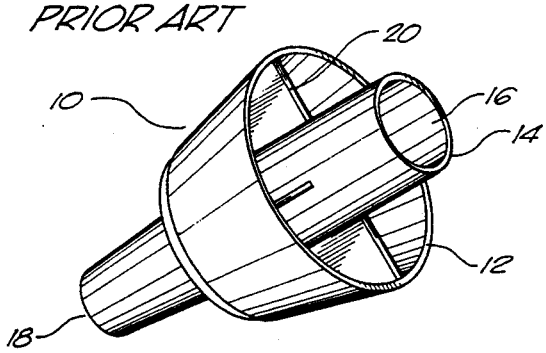
FIG. 1 PRIOR ART
FIG. 1 is a perspective view of a pocket former of conventional configuration.

Referring to FIG. 1, there is shown the conventional prior art pocket former 10. The conventional pocket former 10 includes a body portion 12 with a tubular member 14 extending therethrough. The body portion 12 has a generally frustoconical configuration. The tubular member 14 extends centrally through the frustoconical configuration of the body portion 12. The tubular member 14 is generally tapered from end 16 downwardly toward end 18. The tubular member 14 will serve to allow a tendon to extend centrally therethrough. Similarly, the body portion 12 is tapered downwardly in the direction toward end 18. A plurality of struts 20 extend between the tubular member 14 and the inside of the body portion 12. The tubular member 14 and the body portion 12 are integrally formed together.

Unfortunately, the configuration of the pocket former 10 of the prior art does not facilitate the ability to cut the tendon after the pocket has been formed in a concrete structure. Normally, the diameter of the body portion 12 will be less than three inches. The body portion 12 has a generally circular configuration. The configuration of the body portion 12 makes the eventual pocket, which is formed with the use of the pocket former 10, too small so as to allow for the insertion of a proper cutting device for the cutting of a tendon extending therethrough. Thusly, the design of the pocket former 10 works against the standard principles of allowing one inch or more of cover between the end of the tendon and the outer surface of the concrete.

Figure 2:
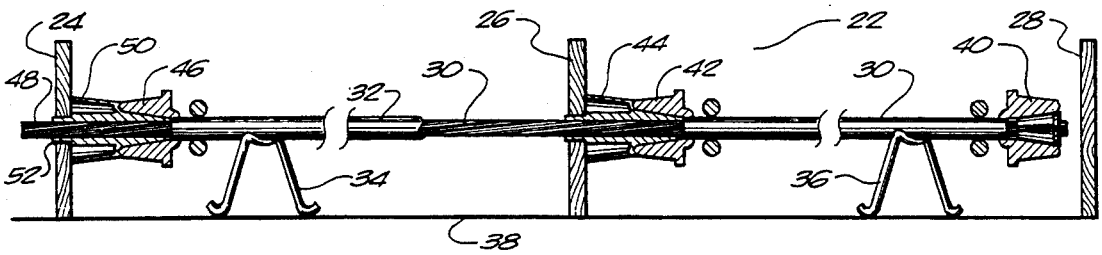
FIG. 2 is a partially cross-sectional view showing the arrangement of pocket formers, anchors, and tendons in typical post-tensioned concrete construction.

As further explanation of the present invention, it can been seen in FIG. 2 that there is illustrated a configuration 22 of a post-tensioned system prior to the pouring of concrete. Initially, it can be seen that there are illustrated three edge forms 24, 26, and 28. The concrete is poured between the edge forms 24 and 26 and between 26 and 28. A tendon, or strand, 30 extends through the edge forms 24 and 26. Each of the edge forms 24 and 26 includes a hole of sufficient size so as to allow the tendon 30 to extend therethrough. The tendon 30 is coated with an extruded plastic sheathing 32. Supports 34 and 36 serve to support the tendon 30 above the bottom surface 38. Initially, a dead end anchor 40 is fastened to one end of tendon 30. The dead end anchor 40 will remain embedded in the concrete, after the concrete is poured. An intermediate stressing anchor 42 extends over the tendon 30 adjacent to the edge form 26. Pocket former 44 is inserted into the interior of anchor 42 and has a portion extending through the opening of the edge form 26. The pocket former 44 serves to form a pocket in the concrete between the anchor 42 and the edge form 26. Normally, this configuration will be at a construction joint in the concrete.

With the present invention, it is important to realize that there is an exterior stressing anchor 46 which is fastened adjacent to an end 48 of the tendon 30. The tendon 30 will extend through the interior of the exterior stressing anchor 46. A pocket former 50 has a portion which is inserted into the interior of anchor 46 around the exterior of tendon 30. The pocket former 50 has a surface which is in abutment with a surface of the edge form 26. The pocket former 50 also includes another portion 52 of tubular configuration which extends through the opening in the edge form 24 and is interposed between the edge form 24 and the tendon 30. The end 48 of tendon 30 will extend outwardly of the edge form 24.

Although FIG. 2 illustrates the use of a pocket former 50 of conventional configuration, FIG. 2 does serve to convey the general arrangement of the pocket former of the present invention and the method of the present invention as applied to a post-tensioned concrete construction.

Figure 3:
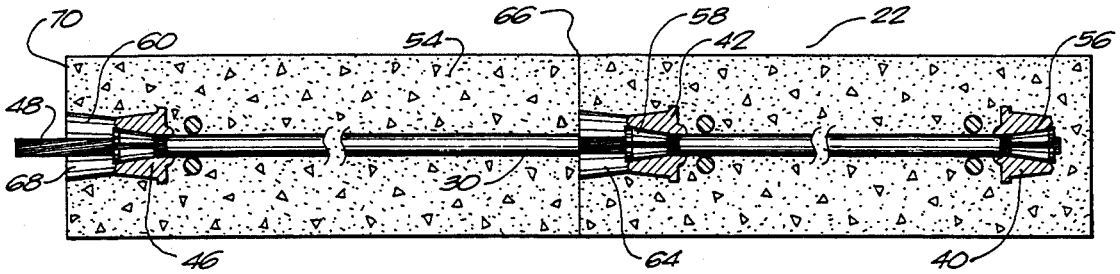
FIG. 3 is a cross-sectional view showing the configuration of pockets formed in post-tensioned concrete construction.

FIG. 3 illustrates the construction 22 of FIG. 2 with the concrete poured and solidified. As can be seen, concrete 54 extends around the exterior of the tendon 30, and the anchors 40, 42, and 46. After the concrete 54 is poured, a tension force is applied to the tendon 30 at the end 48. This will cause the tendon 30 to be stretched and lengthened. During this process, wedges 56, 58, and 60 are inserted into the area between the interior of the anchors 40, 42, and 46, and the exterior of the tendon 30. The initial stretching of the tendon 48 will cause the wedges 56 to remain firmly in place and to grasp the end of the tendon opposite end 48. The wedges 58 and 60 will serve to retain the tendon 30 in its proper position, relative to the anchors 42 and 46, when the tendon 30 is released and the stretched tendon 30 recoils toward its original configuration. This arrangement of anchors, wedges, and the tendon serves to create the "post-tensioned" concrete construction.

Importantly, it can be seen that a pocket 64 is formed at the area of the construction joint 66 adjacent to the end of anchor 42. Similarly, a pocket 68 is formed in the concrete 54 at the end surface 70 adjacent to the end 48 of tendon 30.

After the installation in the manner of FIG. 3, standard practice requires that the end 48 be cut from the remaining tendon 30. Standard practice would normally require that the tendon 48 be cut at a location extending not less than one inch inwardly of the outer surface 70 of the pocket 68. However, conventional practice normally utilizes saws which serve to cut the tendon 30 at an area flush with the end 70 of the pocket 68. After the tendon 30 is cut, the pocket 68 is filled with a grout material so as to seal the remaining end of the tendon 30 within the pocket 68.

Figure 4:
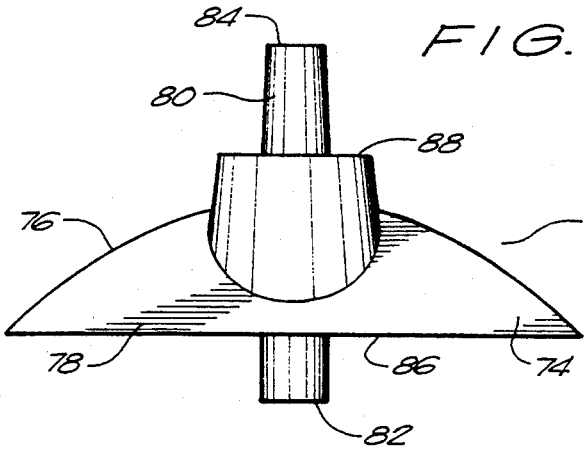
FIG. 4 is a plan view of the pocket former in accordance with the preferred embodiment of the present invention.

So as to eliminate the problems of the prior art pocket formers, pocket former 72 of the present invention is illustrated fully in FIG. 4. Pocket former 72 has a body 74 which has a generally tapered exterior surface 76 (illustrated in greater detail in FIGS. 5 and 6). The body 74 has a top surface 78 and a bottom surface (to be described hereinafter). The tubular member 80 extends through the body 74. In the preferred embodiment of the present invention, the top surface 78 extends above the tubular member 80 for a greater distance than the bottom surface extends below the tubular member 80.

As can be seen in FIG. 4, the tubular member 80 has a first end 82 and a second end 84. The first end 82 extends outwardly beyond an end surface 86 of body 74. Similarly, the second end 84 of tubular member 80 extends outwardly of the other end surface 88 of body 74. As will be described hereinafter, the end surface 86 has a generally semi-circular configuration. The end surface 88 will have a generally circular configuration generally coaxial with the tubular member 80.

Figure 5:
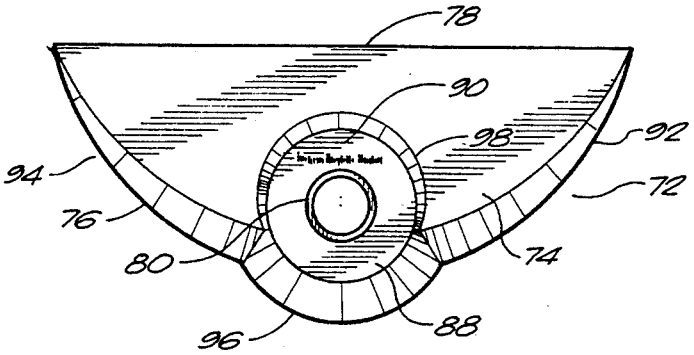
FIG. 5 is a rear elevational view of the pocket former of the present invention.

In FIG. 5, there is shown an end view of the pocket former 72. In particular, the end 88 is illustrated as extending around the tubular member 80 of the pocket former 72. The body 74 is shown as extending outwardly of the tubular member 80. The end surface 88 is shown as having a generally circular configuration. Identification information 90 is provided on the end surface 88. With reference to FIG. 4, the tubular member 80 will extend outwardly from the end surface 88 by a small distance. The body 74 extends outwardly from the end surface 88 upwardly along the tapered exterior surface 76 formed by curved sides 92 and 94. Sides 92 and 94 extend upwardly to the upper surface 78. The bottom surface 96 is positioned below the tubular member 80. As can be seen, the top surface 78 extends above the tubular member 80 by a greater distance than the tubular member 80 extends above the bottom surface 96. Circular area 98 defines the area in which the circular portion of end surface 88 joins with the body 74 of the pocket former 72 of the present invention.

Figure 6:
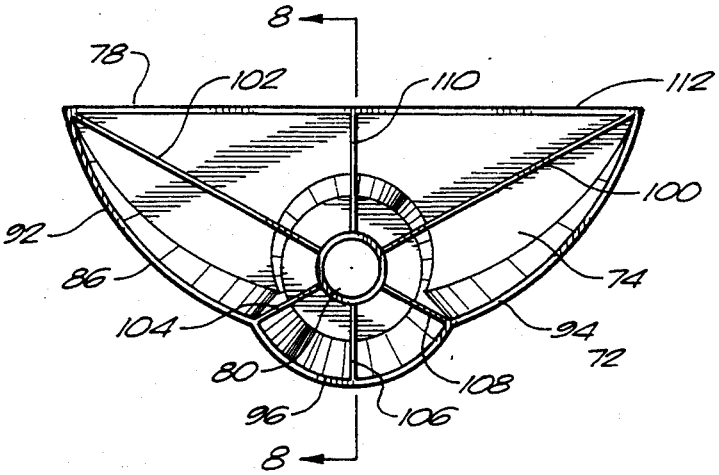
FIG. 6 is a front elevational view of the pocket former of the present invention.

FIG. 6 shows a frontal view of the pocket former 72 of the present invention. In particular, it can be seen that the tubular member 80 extends outwardly from the forward end surface 86. A plurality of struts 100, 102, 104, 106, 108, and 110 extend from the tubular member 80 toward the exterior surfaces of the body 74. These struts serve to hold the elongated body 74 together so as to keep the flatness against the form.

In FIG. 6, it can be seen that the body 74 has end 86 of a generally semi-circular configuration. End 86 has a linear edge 112 extending thereacross. The ends of the top linear edge 112 extend downwardly in a tapered and curved manner along sides 92 and 94 toward the body portion at the end surface 88. It can be seen that the struts 104, 106, and 108 connect the tubular member 80 to the bottom surface 96. The struts 100, 102, and 110 connect the tubular member 80 to the top linear edge 112. These struts will serve to maintain the structural integrity of the pocket former 72 of the present invention.

The top surface 78 of the body 74 extends outwardly for a distance greater than 1½-inches from the tubular member 80. The linear edge 112 has a length of greater than four inches. Normally, this length will be between four and seven inches so as to accommodate the diameter of an angle grinder. As can be seen, the configuration of the linear edge 112 of the top surface 78, along with sides 92 and 94, provide an area which can properly accommodate the outer diameter of an angle grinder wheel. Since the angle grinder wheel is normally used to cut the tendon from the top, the bottom surface 96 is of a circular configuration of shorter radius relative to the tubular member 80.

Figure 7:
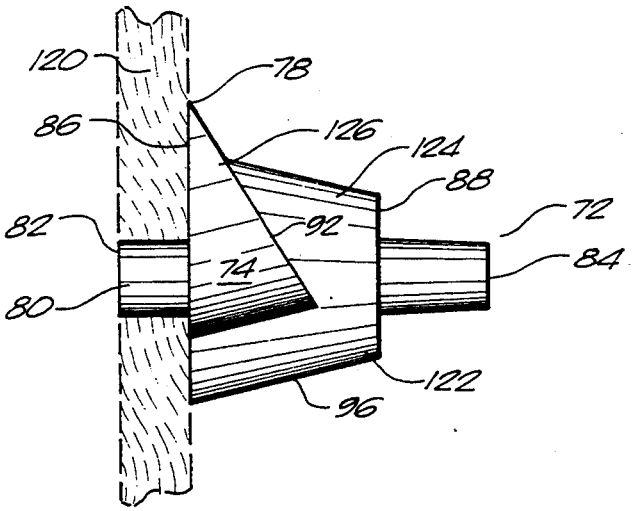
FIG. 7 is a side elevational view of the pocket former of the present invention shown as positioned against an edge form.

In FIG. 7 the pocket former 72 is illustrated as positioned adjacent to an edge form 120. Specifically, the end surface 86 is juxtaposed against a surface of the edge form 120. The tubular member 80 has its end 82 extending through the edge form 120.

In FIG. 7, it can be seen that the pocket former 72 has the first body portion 122 having a generally circular configuration. This circular configuration extends around the tubular member 80 rearwardly of the end 86. The bottom surface 96 is included within this circular configuration. The first body portion 122 extends outwardly from the tubular member 80 at end 88. The exterior surface 124 of the first body portion 122 tapers outwardly toward the end 86. This exterior surface connects with the second body portion 126. As was described previously, the second body portion 126 encompasses the sides 92 and 94 which extend upwardly to the upper surface 78. The upper surface 78 is illustrated as extending above the tubular member 80 by a greater distance than the tubular member 80 extends above the bottom surface 96. The top surface 78 has curved sides 92 and 94 extending to the first portion 122.

Figure 9:
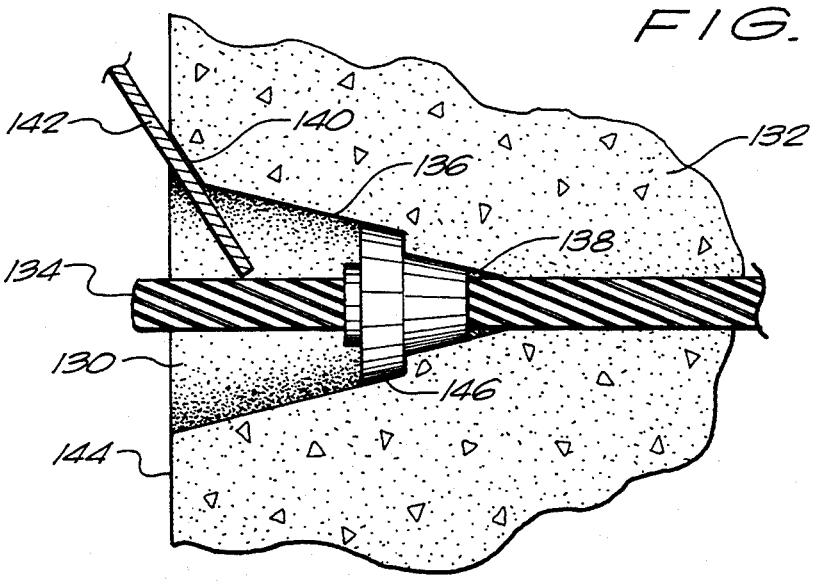
FIG. 9 shows a cross-sectional view of the concrete structure showing the grinder wheel as used in the pocket formed by the present invention.

In FIG. 7, a tendon will extend through the tubular member 80 and outwardly of the edge form 120. It is in this position that the tendon can be properly tensioned. Concrete will be poured around the edge former 72 prior to the tensioning of the tendon. After the concrete is poured and solidified, then the edge form 120 is removed, and the pocket former 72 is removed. FIG. 9 illustrates the configuration of the concrete structure upon the removal of the pocket former.

Figure 8:
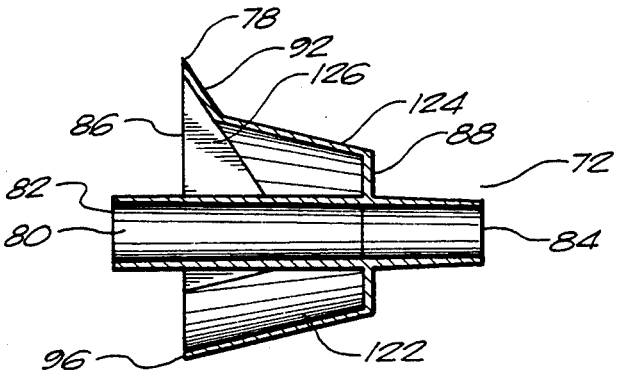
FIG. 8 is a cross-sectional view of the pocket former of the present invention as taken across lines 8—8 of FIG. 6.

FIG. 8 is a cross-sectional view of the pocket former 72. It can be seen that the tubular member 80 extends longitudinally through the interior of the pocket former 72. Tubular member 80 terminates at ends 82 and 84. The first body portion 122 extends outwardly at end surface 88 from the tubular member 80. The first body portion 122 has a frustoconical configuration. The exterior surfaces 124 of the first body portion 122 taper outwardly toward the second body portion 126. The top surface 74 defines a linear edge (described herein previously). End surface 86 has a flat configuration which extends from the top surface 78 to the bottom surface 96. It can be seen that the angled area of entry between the top surface 78 and the exterior of tubular member 80 along the sides 92 and 94 properly allows a grinder wheel to be inserted therein for the purpose of cutting a tendon after the pocket former 72 is removed.

In FIG. 9, it can be seen how the pocket former 72 of the present invention creates a pocket 130 within the concrete structure 132. The pocket 130 extends around a tendon 134 extending through the concrete structure 132. The pocket former 72 forms the pocket 130 having a frustoconical wall 136. An annular area 138 is formed so as to allow the tendon 134 to extend therethrough. Importantly, the angled and curved sides 92 and 94 of the pocket former 72 create an elongated area 140 extending upwardly from the frustoconical area 136. The area 140 provides a wide angled area so as to allow for the proper insertion of a grinder wheel 142. The area 140 provides an angled area of entry for the grinder wheel 142 so as to allow proper access into the interior of the pocket 130. The ends 144 of the structure 132 were formed by the positioning of the edge form 120. In normal use, an anchor 146 is positioned within the cavity 130 prior to the tensioning of the tendon 134. A surface of the anchor 146 will be in abutment with surfaces of the structure 132 in the cavity 130. As can be seen, the tendon 134 will extend outwardly of the anchor 146.

In order to cut the excess portion of the tendon 134 extending outwardly of the anchor 146, the grinder wheel 142 is inserted into the cavity 130 along the angle formed by the second body portion and along edge 140. This configuration allows a proper angle of entry for the grinder wheel 142 for the proper cutting of the tendon 134 more than one inch from the end wall 144. The angle 140 allows the tendon to be cut ¾-inch from the anchor 146 at the top and ½-inch from the anchor 146 at the bottom.

The method of the present invention initially requires the forming of the pocket former of the present invention. After the pocket former is formed, an end 84 of the tubular member 80 is inserted into an anchor member 146, such as that illustrated at 46 in FIGS. 2 and 3. A tendon is then extended through the anchor 146 and through the tubular member 80 of the pocket former 72. Concrete is poured into the form around the pocket former 72 and the anchor 146. After the concrete has solidified, the pocket former is removed from the concrete so as to create an elongated pocket in the concrete. The tendon is then cut inwardly of the outer surface of the pocket.

The tendon 134 should be cut not less than one inch from the outer surface of the pocket. This step of cutting is completed by inserting a grinder wheel into an elongated portion of the pocket. The die grinder wheel is then moved angularly downwardly so as to saw through the tendon 134. When a 1½-inch diameter die grinder wheel is used, the die grinder wheel can be inserted into the cavity and moved vertically downward so as to saw through the tendon 134 of the first body portion 85.

Alternatively, if an angle grinder is used for the cutting of the tendon, the angle grinder wheel is inserted at an angle into the pocket which is formed by the second body portion 126. The tendon 134 is then sawed, at an angle, such that an end of the tendon is no closer than one inch from an outer surface of the pocket.

After the tendon 134 has been properly cut, then the pocket can be filled with a grout material so as to seal the tendon within the pocket. The grout material will be flush with an outer surface of the pocket. The grout can then be solidified so as to properly seal the tendon.

Unlike previous pocket formers, the eccentric design of the present invention allows for the proper insertion of the necessary tools so as to achieve a proper cut of the tendon. Many persons in the construction industry prefer the use of angle cutters when sawing through the tendon. In such a situation, the second body portion 126 creates a cavity that allows for the proper insertion of the large (between four and seven inches in diameter) cutting wheel 142. This larger area will allow a proper angle cut of the tendon.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A pocket former comprising:

a body having a tapered exterior surface, said body having a top surface and a bottom surface, said body having a tubular member extending therethrough, said top surface extending outwardly from said tubular member for a greater distance than said bottom surface extends outwardly from said tubular member, said top surface and said bottom surface defining a pocket therebetween, said top surface having an elongated length greater than a length of said bottom surface, said body having sides tapering to said bottom surface.

2. The pocket former of claim 1, said top surface extending outwardly for a distance greater than one and a half inches.

3. The pocket former of claim 1, said top surface having a length of not less than four inches.

4. A pocket former comprising:

a body having a tapered exterior surface, said body. having a top surface and a bottom surface, said body having a tubular member extending therethrough, said top surface extending outwardly from said tubular member for a greater distance than said bottom surface extends outwardly from said tubular member, said top surface and said bottom surface defining a pocket therebetween, said pocket having an end with generally semi-circular configuration, said top surface forming a generally linear edge of said semi-circular configuration, said linear edge having a length of between four inches and seven inches.

5. The pocket former of claim 4, said pocket having another end of circular configuration, said linear edge tapering to said another end, said circular configuration being of lesser diameter than said semi-circular configuration.

6. The pocket former of claim 4, said tubular member positioned within said pocket adjacent a curved portion of said semi-circular configuration.

7. The pocket former of claim 1, said body having a plurality of radial struts extending from said tubular member to said top and bottom surfaces.

8. A pocket former comprising:

a body having a tapered exterior surface, said body having a top surface and a bottom surface, said body having a tubular member extending therethrough, said top surface extending outwardly from said tubular member for a greater distance than said bottom surface extends outwardly from said tubular member, said top surface and said bottom surface defining a pocket therebetween, said body comprising:

a first portion having a generally circular configuration, said circular configuration extending around said tubular member, said circular configuration including said bottom surface; and a second portion having a generally semi-circular configuration, said second portion having a generally linear edge with a length of not less than four inches, said linear edge being said top surface, said second portion having curved sides extending to said first portion.

9. The pocket former of claim 8, said tubular member having a length greater than a thickness of said first and second portions.

* * * * *